US012637181B2

(12) United States Patent
Cadman

(10) Patent No.: US 12,637,181 B2
(45) Date of Patent: May 26, 2026

(54) PADDLEBOARD BOARDING ASSISTANCE DEVICE

(71) Applicant: Gena Elizabeth Cadman, St. Louis Park, MN (US)

(72) Inventor: Gena Elizabeth Cadman, St. Louis Park, MN (US)

( * ) Notice: Subject to any disclaimer, the term of this patent is extended or adjusted under 35 U.S.C. 154(b) by 702 days.

(21) Appl. No.: 18/059,995

(22) Filed: Nov. 30, 2022

(65) Prior Publication Data

US 2023/0174199 A1 Jun. 8, 2023

Related U.S. Application Data

(60) Provisional application No. 63/284,340, filed on Nov. 30, 2021.

(51) Int. Cl.
*B63B 32/40* (2020.01)
*B63B 32/70* (2020.01)

(52) U.S. Cl.
CPC ..... *B63B 32/40* (2020.02); *B63B 32/70* (2020.02)

(58) Field of Classification Search
CPC ..... B63B 32/40; B63B 32/70; B63B 32/00; B63B 17/00; B63C 9/00
USPC ..... 114/362; 441/80
See application file for complete search history.

(56) References Cited

U.S. PATENT DOCUMENTS

| | | | | |
|---|---|---|---|---|
| 7,455,028 | B2 * | 11/2008 | Baker | B63B 27/146 114/362 |
| 7,585,197 | B1 * | 9/2009 | Merten | B63B 27/146 441/80 |
| 8,894,457 | B1 | 11/2014 | Crozier | |
| 10,647,396 | B2 | 5/2020 | Marjan et al. | |
| 2015/0004859 | A1 | 1/2015 | Tascheri D'Ausilio | |

* cited by examiner

*Primary Examiner* — Lars A Olson
(74) *Attorney, Agent, or Firm* — Gutwein Law; Tyler B. Droste

(57) ABSTRACT

A device for attachment to a rideable object upon a water surface, such as, but not limited to a paddleboard, to provide a grasping surface and foothold to aid in righting and boarding the rideable object. The device is configured for universal use, wherein it is adjustable for multiple sizes and types of rideable objects or paddleboards. The device is comprised of a connecting portion having a first end and a second end opposed the first end. The connecting portion includes a selectable position and attachment means to enable fixing the device to the rideable object. A second end of the device includes a loop member configured to dangle below the rideable object to provide a foothold for boarding and righting the object.

3 Claims, 6 Drawing Sheets

PADDLEBOARD BOARDING ASSISTANCE DEVICE

CROSS REFERENCE TO RELATED APPLICATIONS

This application claims priority to U.S. Provisional Patent Application No. 63/284,340 filed 30 Nov. 2021 titled "PADDLEBOARD ROPE APPARATUS" to the above named inventor, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The invention relates generally to a device configured for attachment to a rideable object for use upon a water surface to aid a user in righting the rideable object. More particularly, the device of the present disclosure relates to paddleboards and provides a device configured for attachment to the paddleboard and extending below a surface of the water the paddleboard is placed upon to aid a user in righting and mounting the paddleboard from a position within the water.

BACKGROUND

A paddleboard or other rideable object when used upon a water surface requires balance and coordination to operate. Typically, a user boards or rides these objects by mounting the object from a beach, shoreline, pier, or dock enabling them to stand or sit directly onto the object from a position above the water surface the object is placed upon. Due to the inherent properties of water, righting or boarding an object floating upon the surface of a body of water can often be a difficult task. This is especially true when the object is floating in water having a depth greater than a height of the user. This depth prevents a user from using their legs to push upwards to aid in the boarding and righting process. Accordingly, this task of righting a floatable object typically requires a quantum of upper body strength that not all user's may have.

In a typical righting process under this above scenario, the user will attempt to stabilize the rideable object upon the water surface by placing the palms of their hands flat upon an upper surface of the rideable object and then pushing downwards in an attempt to raise their lower torso and legs up and upon the upper surface of the rideable object. Often during this process, the rideable object will have a tendency to sway or rock requiring additional strength for stabilization of the object during righting. Accordingly, this process can be difficult for some user's and may require several attempts or assistance from others. To aid in this process, some rideable objects will utilize handles or grasping members to allow the user to grasp and pull themselves up and upon the rideable object. Although generally helpful, these handles do not extend into the water, are not adjustable, and generally do not allow a user to use their lower body and legs to help in this in-water boarding process.

U.S. Pat. No. 10,647,396 generally provides an apparatus for placement on a paddleboard utilizing a strap secured around a waist portion of the paddleboard for securing a pair of oars along opposed edges of the paddleboard. Although presenting additional objects to grasp and manipulate during boarding, this apparatus does not provide a boarding and righting solution, but rather provides an additional propulsion mechanism. U.S. Pat. No. 8,894,457 provides a paddleboard tether in the form of a leash device configured for attachment between a user and the paddleboard to ensure that the paddleboard is in control of the user during activities. Although useful in preventing the loss of a paddleboard during surfing activities, the leash device is not helpful or configured for use in righting or mounting the paddleboard. Further, US Pat. Appl. Publ. No. 2015/0004859 provides a rope-like harness assembly for generally supporting a user of the paddleboard in an upright position. Although the harness of the '859 reference provides support, it is not useful or configured to aid in boarding or righting an object upon a water surface. Therefore, there exists a need for a specific and dedicated apparatus that is configured for attachment to a rideable object upon a water surface adapted to provide stability, attachment/grasping surfaces, adjustability, and a looped end forming a stirrup-like foothold for boarding.

SUMMARY OF THE INVENTION

The device of the present disclosure is most generally configured as a device for attachment to a rideable object upon a water surface, such as, but not limited to a paddleboard, to provide a grasping surface and foothold to aid in righting and boarding the rideable object. The device is generally configured for universal use, wherein it is adjustable for multiple sizes and types of rideable objects or paddleboards.

The device is most generally configured as an assistance device to facilitate an easier boarding process upon an object that is placed upon a surface of water. The device is comprised of a connecting portion having a first end and a second end opposed the first end. The first end and the second end define the ends of the device with a distance between the first end and the second end defining a length of the connecting portion.

The first end having a first attachment means configured for securing upon a surface or existing attachment point of the object, wherein the attachment means anchors the first end of the device to the rideable object. The attachment means preferably comprises a clip or similar-style fastener. In a preferred method of use of the device, the attachment means is secured at a middle position of the rideable object such as by securing the first end to a grasping handle by securing the clip around the handle.

The connecting portion including a selectable position comprising a second attachment means that is movable between the first end and the second end along the length of the connecting portion. The second attachment means generally mirroring the first attachment means and configured for securing upon a surface or existing attachment point of the object, wherein the second attachment means anchors the selectable position of the device to the rideable object. The second attachment means preferably comprises a clip or similar-style fastener. In a preferred method of use of the device, the second attachment means is secured at an end position along a length of the rideable object such as by securing the selectable position to a grasping handle, or ring member, by securing the clip around the handle or ring to fix the selectable position on the rideable object.

The second end of the device generally forming a loop. The loop having an adjustable diameter through a clasp, wherein the clasp is capable of movement along the connecting portion length to adjust the adjustable diameter of the loop. The loop forms a foothold or stirrup for receipt of a foot of a user to generally provide a fixed surface to push against to aid the user in boarding the object the device is placed upon.

In a preferred embodiment of the device, the connecting portion includes at least one handle member, the at least one handle member movably received along the length of the connecting portion and configured to provide a raised and dedicated grasping surface configured for placement within the palm of a user for pulling and gripping during use. The connecting portion can include a plurality of handle members wherein multiple handle members can be fixed and moved along the length to provide multiple and adjustable grasping handles for boarding the rideable object.

The device first attachment means and the second attachment means can be adjusted and secured along the length of the connecting portion to accommodate various sizes and types of rideable objects. In the case of a paddleboard, the first attachment means will be secured to the middle portion and the second attachment means will be secured to an end of the board along the length with the second end dangling in the water.

To use the device in specifically righting a paddleboard, the user will generally affix the connecting portion first end and selectable position to the upper surface of the paddleboard at a substantially middle position and end of the paddleboard. The second end of the connecting portion is then draped off the end of the paddleboard adjacent the selectable position where the loop portion will dangle in the water below the paddleboard. The loop position below the water surface provides for use a step to allow a user to right the paddleboard from an end. To aid in this process the handle member can be moved along the connecting portion length to provide an additional grasping surface for a user when righting the paddleboard.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
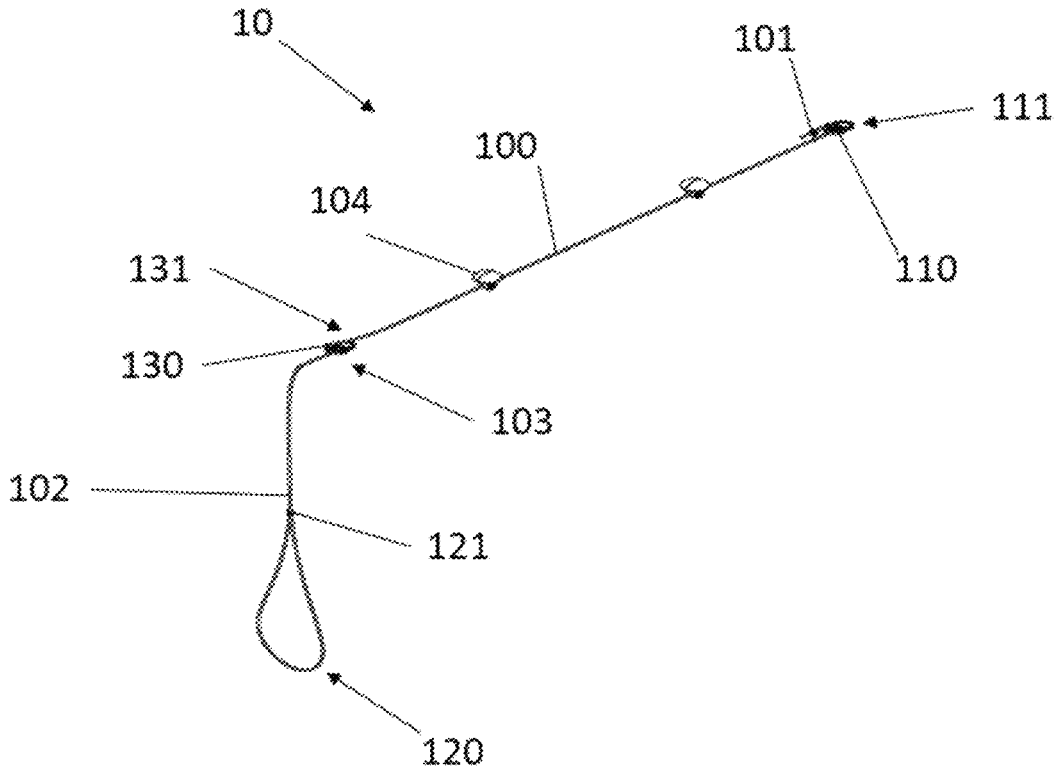
FIG. 1 shows a perspective view of the device, according to the present disclosure.
Figure 2:
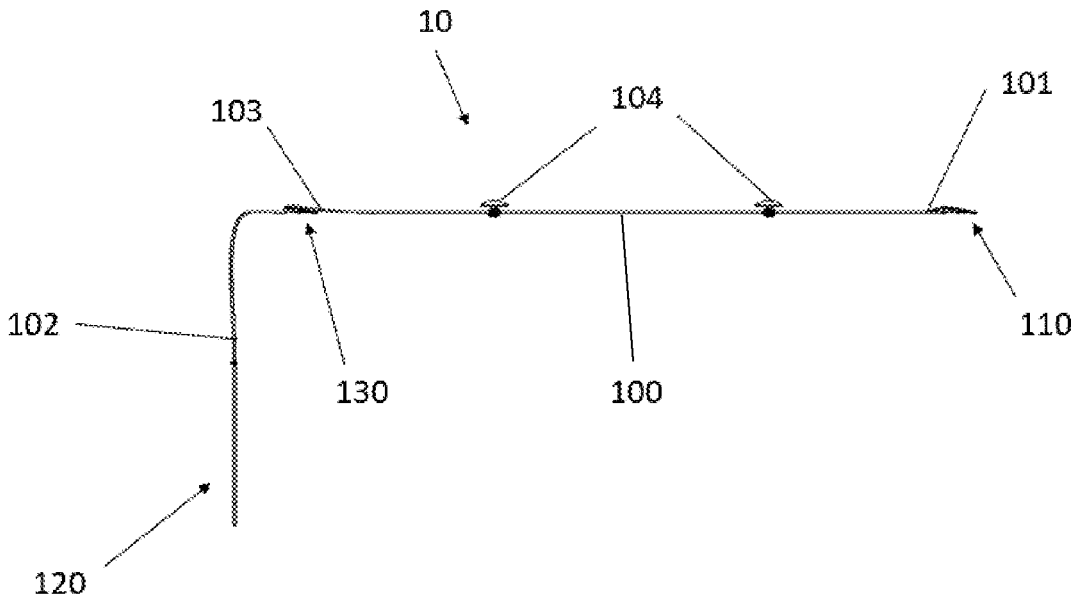
FIG. 2 is a side view of the device, according to the present disclosure.
Figure 3:
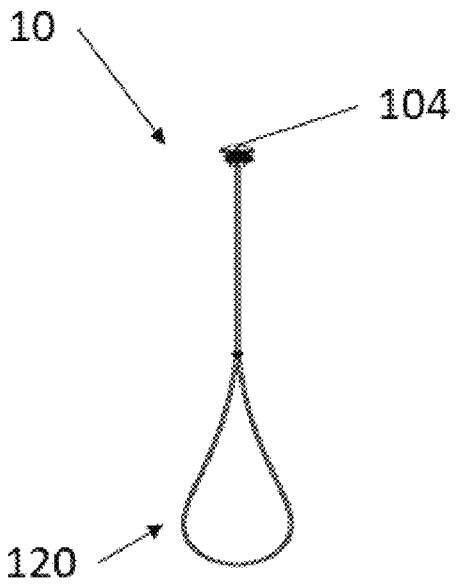
FIG. 3 is an end view of the device, according to the present disclosure.
Figure 4:
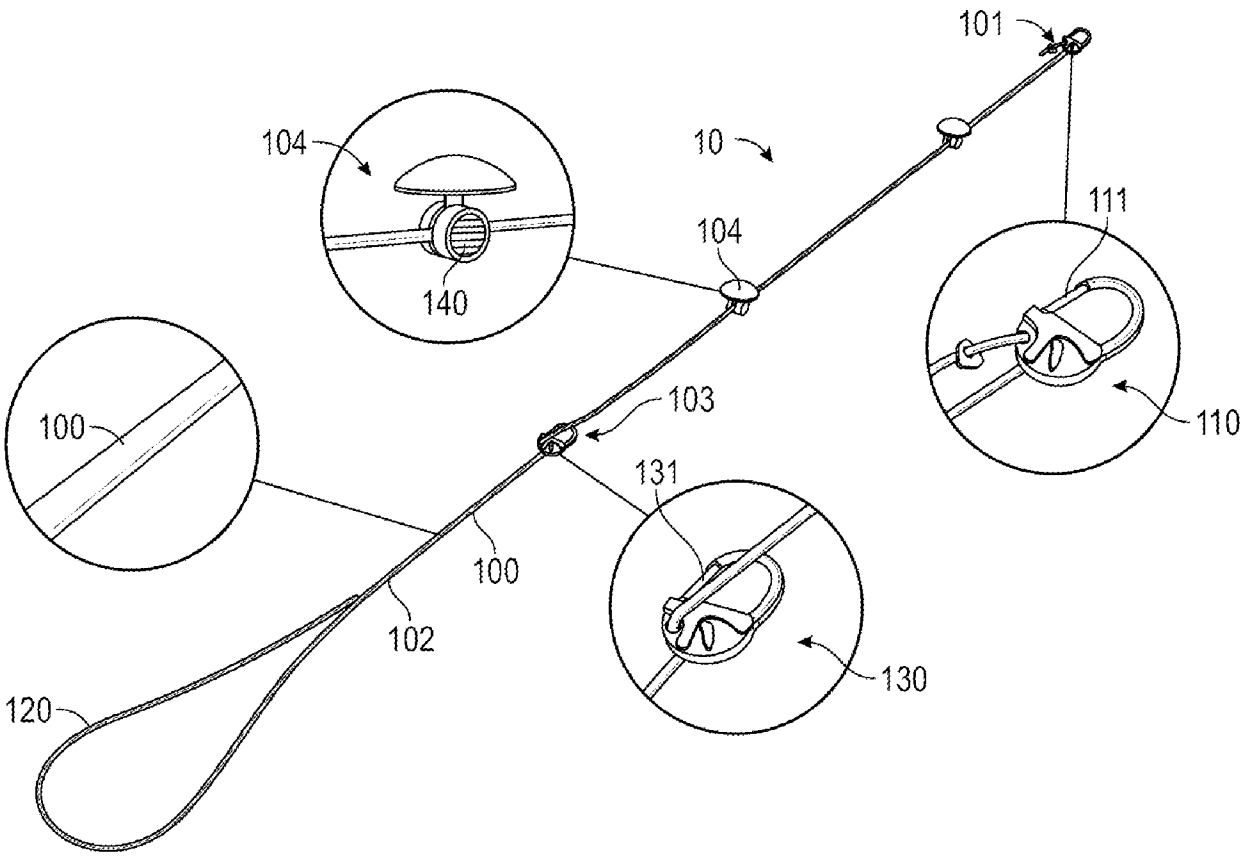
FIG. 4 is a top side view of the device showing various components in an exploded view, according to the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Referring now to FIGS. 1-6, of the paddleboard boarding assistance device, referred generally herein as device 10. The device 10 is most generally configured as an assistance device to facilitate an easier boarding process upon an object that is placed upon a surface of water. The device 10 is most generally comprised of a connecting portion 100 having a first end 101 and a second end 102 opposed the first end 101. The first end 101 and the second end 102 define the ends of the device 10 with a distance between the first end 101 and the second end 102 defining a length of the connecting portion 100. The first end 101 having a first attachment means 110. The first attachment means 110 configured for securing upon a surface or existing attachment point of the object, wherein the attachment means 110 anchors the first end 101 of the device 10 to the rideable object. The attachment means 110 preferably comprises a clip 111 or similar-style fastener, such as including, but not limited to, a carabiner, a hook and loop style fastener/wrap, a swivel eye bolt snap, a halter snap, a marine style carabiner clip, a locking cam having a style similar to the CamJam branded cord tightening device, or other similar retaining and securing means. In a preferred method of use of the device 10, the attachment means 110 is secured at a middle position of the rideable object such as by securing the first end 101 to a grasping handle by securing the clip 111 around the handle.

The connecting portion 100 including a selectable position 103. The selectable position 103 comprising a second attachment means 130 and movable between the first end 101 and the second end 102 along the length of the connecting portion 100. The second attachment means 130 generally mirroring the first attachment means 110 and configured for securing upon a surface or existing attachment point of the object, wherein the second attachment means 130 anchors the selectable position 103 of the device 10 to the rideable object. The second attachment means 130 preferably comprises a clip 131 or similar-style fastener, such as including, but not limited to, a carabiner, a hook and loop style fastener/wrap, a swivel eye bolt snap, a halter snap, a marine style carabiner clip, a locking cam having a style similar to the CamJam branded cord tightening device, or other similar retaining and securing means. In a preferred method of use of the device 10, the second attachment means 130 is secured at an end position along a length of the rideable object such as by securing the selectable position 103 to a grasping handle, or ring member, by securing the clip 131 around the handle or ring to fix the selectable position 103 on the rideable object.

The second end 102 of the device 10 generally forming a loop 120. The loop 120 having an adjustable diameter through a clasp 121, wherein the clasp 121 is capable of movement along the connecting portion 100 length to adjust the adjustable diameter of the loop 120. The loop 120 generally forming a foothold or stirrup for receipt of a foot of user to generally provide a fixed surface to push against to aid the user in boarding the object the device 10 is placed upon. In an alternate embodiment of the present disclosure, the clasp 121 provides a connector for a strap-like member that is affixed to the second end 102 and forming the loop 120. In this alternate embodiment, the strap like member may be padded or provide a wider surface similar to a traditional step. In use of the device 10, the loop 120 is positioned to hang off of an edge of the rideable object at the selectable position 103 and dangle into the water below the rideable object to create the foot hold or step to enable a user to better right the object.

The connecting portion 100 is comprised of a material that enables grasping, wherein the connecting portion 100 is comprised of a material having a diameter that can be held and utilized as a hold. This connecting portion 100 material preferably selected from the following materials all having properties to allow for adjustment, use in a wet environment or within water, and strength to support at least a portion of the body weight of a user. The connecting portion 100 material preferably being a marine grade rope comprised of nylon, polyester, or polypropylene in a braided or unbraided assembly, a nylon strap, or paracord in the form of a nylon Kernmantle style rope.

In a preferred embodiment of the device 10, the connecting portion includes at least one handle member 104, the at least one handle member 104 movably received along the length of the connecting portion 100. The at least one handle member 104 configured to provide a raised and dedicated grasping surface configured for placement within the palm of a user for pulling and gripping during use. The connecting portion 100 can include a plurality of handle members 104 wherein multiple handle members 104 can be fixed and moved along the length to provide multiple and adjustable grasping handles for boarding a rideable object. In a preferred embodiment the handle member 104 includes a spring loaded clip 140 that allows for adjustment of the position of the handle member 104 along the connecting portion 100 length.

The device 10 first attachment means 110 and the second attachment means 130 can be adjusted and secured along the length of the connecting of the portion 100 to accommodate various sizes and types of rideable objects. In the case of a paddleboard, the first attachment means 110 will be secured to the middle portion and the second attachment means 130 will be secured to an end of the board along the length with the second end 102 dangling in the water.

Figure 5:
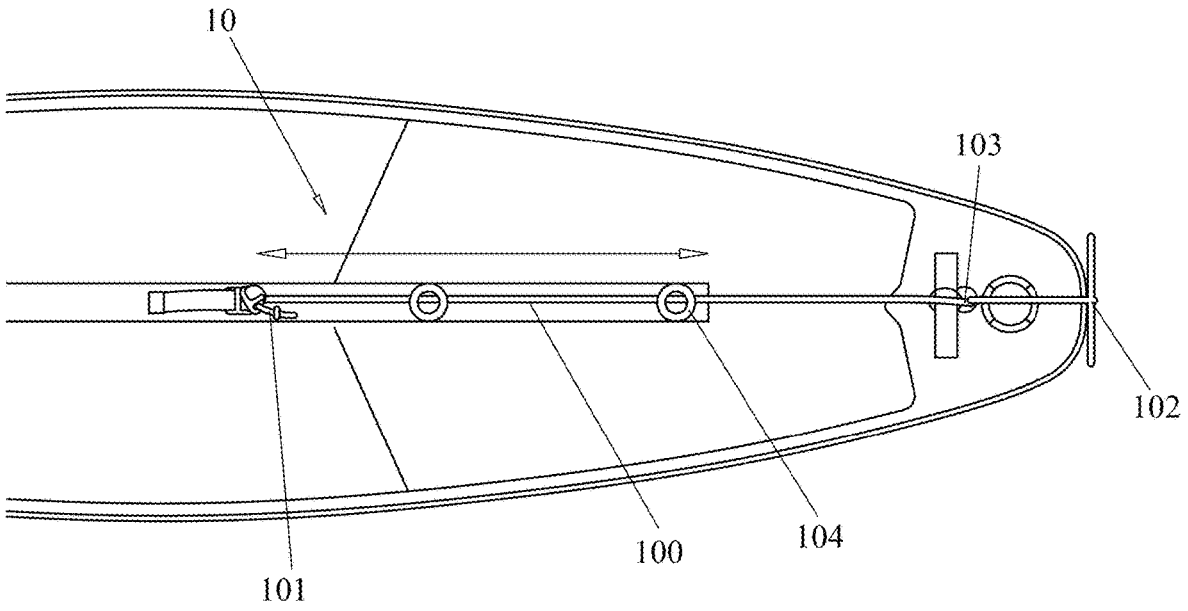
FIG. 5 shows a top side view of the device installed upon a paddleboard, according to the present disclosure.
Figure 6:
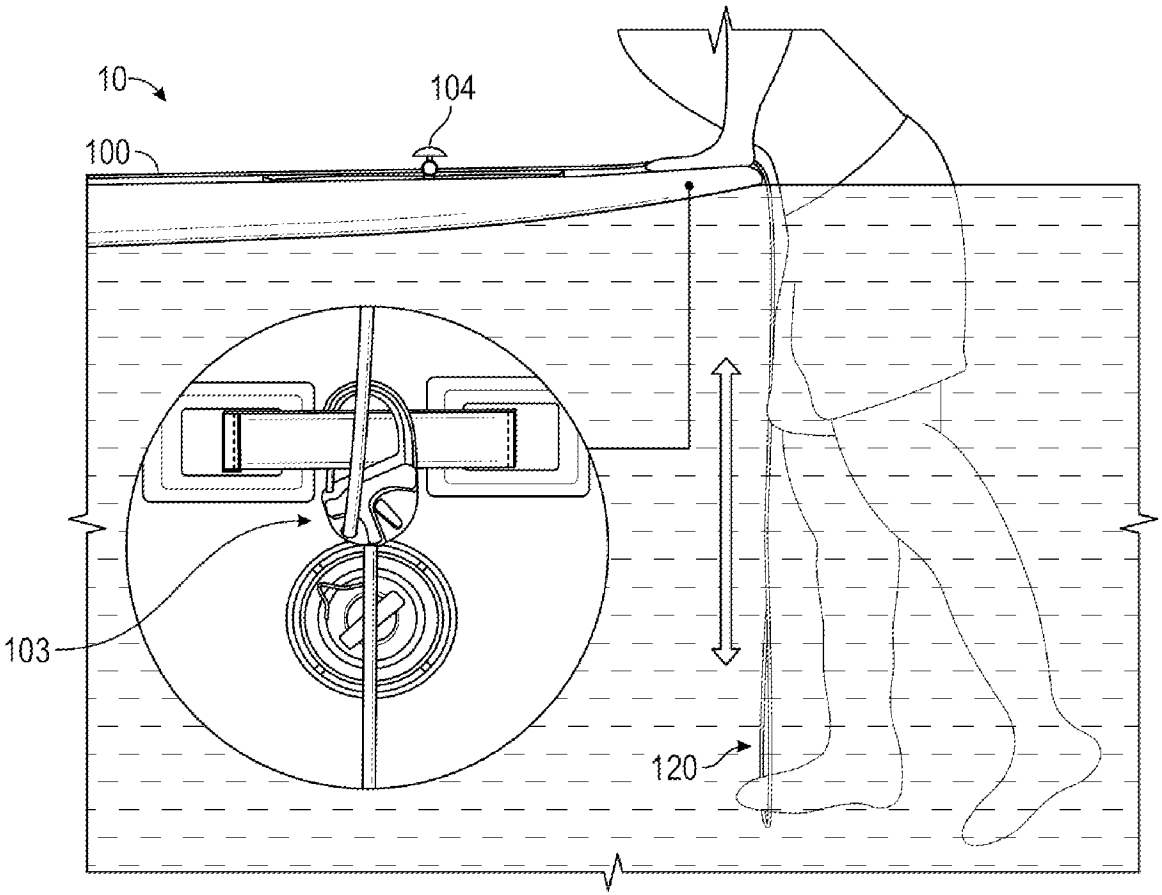
FIG. 6 shows a side view of the device in use on a paddleboard to show a method of boarding the paddleboard with the device, according to the present disclosure.

Referring now to FIG. 5-6, to use the device 10 in specifically righting a paddleboard, the user will generally affix the device 10 connecting portion 100 first end 101 and selectable position 103 to the upper surface of the paddleboard at a substantially middle and end position of the paddleboard. Accordingly, as depicted in the figures, the first end 101 is secured to by using the first attachment means 110 clip 111 to anchor the first end 101 upon the board by securing the clip 111 to a raised grasping handle at this middle position. The connecting portion 100 is then extended along a length of the paddleboard to an end of the paddleboard. The selectable position 103 is then moved along the connecting portion 100 to be in alignment with an attachment surface, such as handhold/strap or D-ring that is commonly found on each end of a paddleboard. The second attachment means 130 of the selectable position 103 is then secured to this attachment surface on the upper surface of the paddleboard with the clip 131. The second end 102 of the connecting portion 100 is then draped off the end of the paddleboard adjacent the selectable position 103 where the loop portion 120 will dangle in the water below the paddleboard. The loop 120 provides a foothold, wherein a user will place a foot into the loop 120 and push downwards against the loop 120 to raise their body above the paddleboard for righting.

The connecting portion 100 first end 101 and second end 102 length can be adjusted to accommodate various sizes of users and paddleboards, wherein the distance the second end 102 dangles in the water can be adjusted. In a preferred method of use, the distance of the second end 102 hanging in the water should be adjusted to closely conform to the body size of the user to provide a fixed position that can be utilized as the step to allow the user to right the paddleboard from an end. To aid in this process the handle member 104 can be moved along the connecting portion 100 length to provide an additional grasping surface for a user when righting the paddleboard. Due to the buoyancy of objects upon a water surface, it is desired that a user of the device 10 affix the device 10 to the rideable object in a manner to maximize effectiveness of use; for a paddleboard this attachment should be along the length as opposed to the width or across the waist of the paddleboard to prevent tipping or capsize during the righting process.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A method for righting an object by a user of a device upon a water surface, device to aid a user in boarding and righting a rideable object upon a water surface, the device comprising:

a first end;

a second end opposite the first end; a distance between the first end and the second end defining a length of the device;

a connecting portion, the connecting portion extending the length of the device between the first end and the second end and having a selectable position between the first end and the second end, the connecting portion having a sufficient diameter to provide a grasping or gripping surface;

a first attachment means, the first attachment means positioned on the first end and configured to secure the first end and connecting portion to a first position on the rideable object;

a second attachment means, the second attachment means positioned adjacent the selectable position of the connecting portion, the second attachment means configured to secure the connecting portion to a second position on the rideable object;

a looped member, the looped member positioned on the second end and configured to provide a grasping or stepping surface for righting the rideable object; and at least one handle member, the at least one handle member movably received along the length of the connecting portion, the at least one handle member configured to provide a grasping surface positioned on a surface of the rideable object;

the method comprising the steps of:

securing the first end of the device to a substantially middle portion of the rideable object through the first attachment means;

extending the connecting portion along a remaining length of the rideable object from the substantially middle portion to an end portion of the rideable object;

moving a selectable position to be in alignment with the end portion of the rideable object;

securing the selectable position to the end portion through the second attachment means;

allowing the second end of the device to dangle off the end of the rideable object below a surface of the water; and placing a foot of the user into a loop at the second and stepping upwards and upon the rideable object.

2. The method as in claim 1, wherein the method comprises the additional steps of:

adjusting a position of a handle member along a length of the connecting portion to provide a grasping surface.

3. The method as in claim 1, wherein the method comprises the additional steps of:

adjusting a relative length of the connecting portion to conform to the user by moving one of either the first end, the second end, or the selectable position.

* * * * *